US009217966B1

(12) United States Patent
Kondo

(10) Patent No.: US 9,217,966 B1
(45) Date of Patent: Dec. 22, 2015

(54) FIXING DEVICE AND IMAGE FORMING APPARATUS

(71) Applicant: KYOCERA Document Solutions Inc., Osaka-shi (JP)

(72) Inventor: Akihiro Kondo, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/721,611

(22) Filed: May 26, 2015

(30) Foreign Application Priority Data

May 27, 2014 (JP) ..... 2014-109116

(51) Int. Cl.
*G03G 15/20* (2006.01)

(52) U.S. Cl.
CPC ..... *G03G 15/2039* (2013.01)

(58) Field of Classification Search
CPC ..... G03G 15/2039; G03G 15/2042; G03G 15/2078; G03G 15/2017; G03G 15/2021; G03G 2215/00599; G03G 21/14; G03G 13/20; G03G 15/2082; G03G 2215/00455; G03G 2215/20; G03G 2215/2009; G03G 9/0821; G03G 9/0928; G06K 15/12
USPC ..... 399/67, 69, 122, 333
See application file for complete search history.

(56) References Cited

U.S. PATENT DOCUMENTS

2006/0088326 A1* 4/2006 Nakayama ..... G03G 15/2046 399/69
2006/0210332 A1* 9/2006 Tsueda ..... G03G 15/2014 399/333
2009/0238593 A1* 9/2009 Kinouchi ..... G03G 15/2042 399/67

FOREIGN PATENT DOCUMENTS

JP 58129450 A * 8/1983
JP 02195369 A * 8/1990
JP 2002-311744 A 10/2002

* cited by examiner

*Primary Examiner* — Francis Gray
(74) *Attorney, Agent, or Firm* — Studebaker & Brackett PC

(57) ABSTRACT

A fixing device includes a first rotatory body, a first heater, a second rotatory body, a temperature detection section, and a determination section. The first heater heats the first rotatory body. The second rotatory body and the first rotatory body provide a fixing nip where a recording medium becomes sandwiched. The temperature detection section detects a temperature change in an end portion of an outer circumferential surface of the first rotatory body. The determination section determines a rotation state of the first rotatory body based on a result of detection by the temperature detection section. The end portion of the first rotatory body has at least one first region and at least one second region that are arranged adjacent to each other in the circumferential direction. The first region has a first thermal conductivity. The second region has a second thermal conductivity that is different from the first thermal conductivity.

8 Claims, 7 Drawing Sheets

FIXING DEVICE AND IMAGE FORMING APPARATUS

INCORPORATION BY REFERENCE

The present application claims priority under 35 U.S.C. §119 to Japanese Patent Application No. 2014-109116, filed May 27, 2014. The contents of this application are incorporated herein by reference in their entirety.

BACKGROUND

The present disclosure relates to a fixing device and an image forming apparatus.

An electrophotographic image forming apparatus includes a fixing device that fixes toner on a recording medium. The fixing device fixes toner by applying heat and pressure onto the recording medium while the recording medium carrying unfixed toner is passing through a pressure nip formed between a heating rotatory body and a pressure roller. A heater that heats the pressure nip is provided inside of the heating rotatory body.

While the heater is heating the heating rotatory body, the heating rotatory body or the pressure roller is thermally-expanded. Such thermal expansion may cause fluctuation of the conveyance speed of the recording medium at the pressure nip, leading to blurring in an image that is formed. The heating rotatory body may be deformed if heated while in a suspended state. Some fixing devices employ an optical sensor (a reflective sensor or a transmissive sensor) to detect the rotation state of a heating rotatory body and control the heating rotatory body to maintain an appropriate rotation speed. Generally, a semiconductor device is used for such an optical sensor.

SUMMARY

A fixing device according to the present disclosure fixes a toner on a recording medium. The fixing device includes a first rotatory body, a first heater, a second rotatory body, a temperature detection section, and a determination section. The first rotatory body is rotatable in a circumferential direction thereof. The first heater heats the first rotatory body. The second rotatory body is rotatable. The second rotatory body is disposed opposite to the first rotatory body. The second rotatory body and the first rotatory body provide a fixing nip therebetween where the recording medium becomes sandwiched. The temperature detection section detects a temperature change in an end portion of an outer circumferential surface of the first rotatory body. The determination section determines a state of rotation of the first rotatory body based on a result of detection by the temperature detection section. The end portion of the first rotatory body has at least one first region and at least one second region. The first region and the second region are arranged adjacent to each other along the circumferential direction. The first region has a first thermal conductivity. The second region has a second thermal conductivity. The second thermal conductivity is different from the first thermal conductivity.

An image forming apparatus according to the present disclosure includes the above-described fixing device and an image forming section. The image forming section transfers the toner to the recording medium. The fixing device fixes the toner on the recording medium.

DETAILED DESCRIPTION

Figure 1:
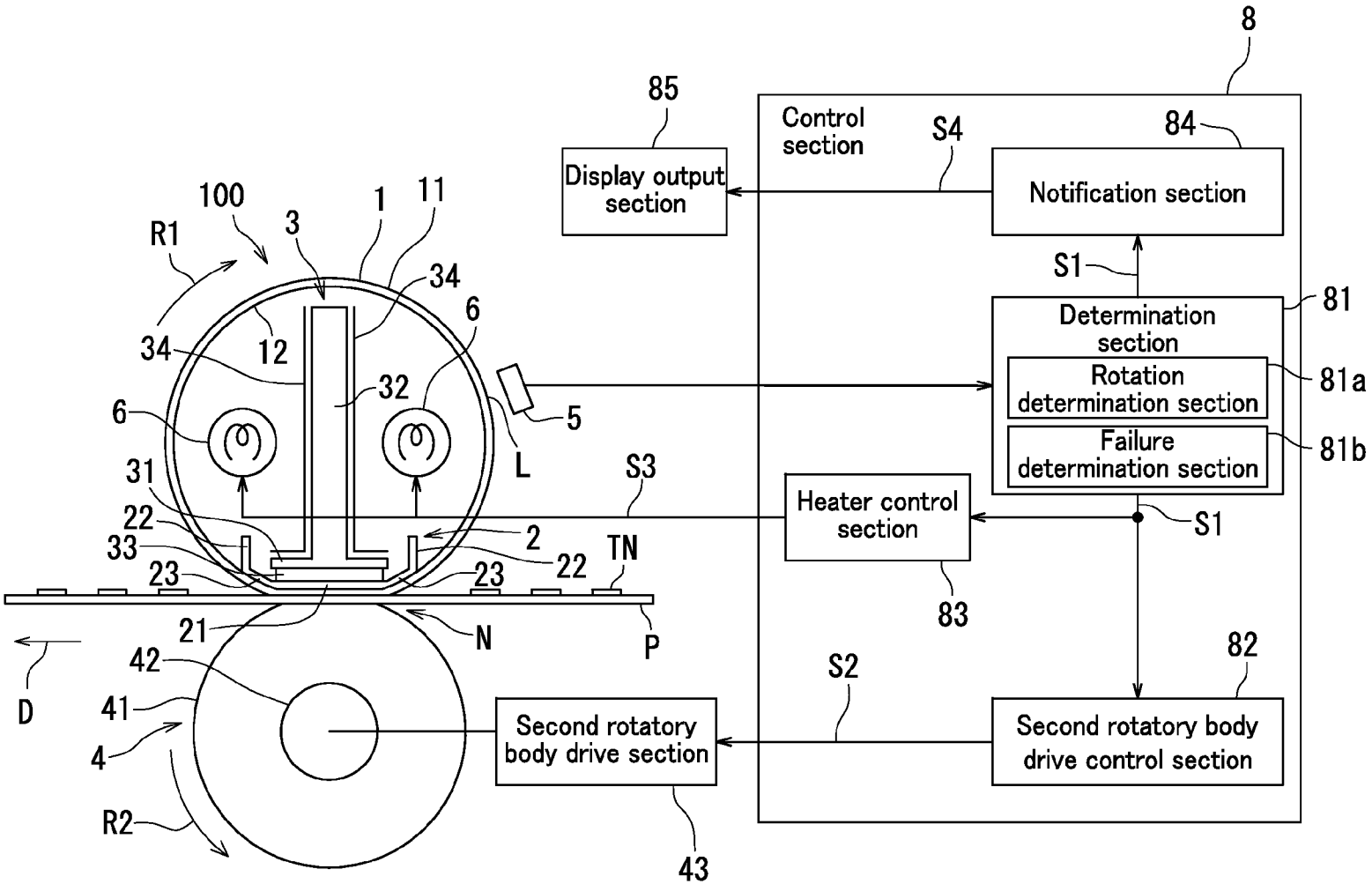
FIG. 1 is a block diagram illustrating functions of a fixing device according to a first embodiment of the present disclosure.

Hereinafter, embodiments of the present disclosure will be described with reference to the accompanying drawings. It should be noted that elements in the drawings that are the same or equivalent are labelled using the same reference signs and description thereof is not repeated.

First Embodiment

A general configuration of a fixing device 100 according to a first embodiment of the present disclosure will be described with reference to FIG. 1. FIG. 1 is a block diagram illustrating functions of the fixing device 100.

The fixing device 100 includes a first rotatory body 1, a second rotatory body 4, two first heaters 6, a temperature detection section 5, and a control section 8. The fixing device 100 is for example mounted in an image forming apparatus. The fixing device 100 applies heat and pressure to a recording medium P to melt and fix unfixed toner TN on the recording medium P.

The first rotatory body 1 is a hollow cylindrical heating rotatory body. The first rotatory body 1 is in a roll form (an endless belt form) and is heat resistant. The first rotatory body 1 is rotatable in a circumferential direction (rotation direction R1) about a rotation axis extending in a direction perpendicular to a conveyance direction D of the recording medium P. The first rotatory body 1 is formed from a plurality of layers stacked on one another. The plurality of layers include a metal layer, an elastic layer, and a release layer. The elastic layer is disposed over an outer circumferential surface of the metal layer. The release layer is disposed over an outer circumferential surface of the elastic layer. The metal layer is for example a steel use stainless (SUS) film having a thickness of 30 μm. The elastic layer is a silicone rubber film having a thickness of 0.3 mm. The release layer is a heat resistant fluororesin film of PFA (tetrafluoroethylene-perfluoroalkylvinylether copolymer) or PTFE (polytetrafluoroethylene) having a thickness of 30 μm.

The second rotatory body 4 is a solid cylindrical pressure roller. The second rotatory body 4 includes an outer circumferential surface 41 and a roller shaft 42. The second rotatory body 4 is rotatable about the roller shaft 42 (rotation axis). The roller shaft 42 is in parallel with the rotation axis of the first rotatory body 1. Hereinafter, a direction along the rotation axis of the first rotatory body 1 and the roller shaft 42 of the second rotatory body 4 is referred to simply as an "axial direction". The second rotatory body 4 includes a metal core, an elastic layer, and a release layer. The elastic layer is disposed over an outer circumferential surface of the metal core. The release layer is disposed over an outer circumferential surface of the elastic layer. The metal core is for example an aluminum or iron member having a diameter of 14 mm. The elastic layer is a silicone rubber film having a thickness of 5.5 mm. The release layer is a fluororesin film such as PFA or PTFE having a thickness of 50 μm. The roller shaft 42 is directly connected with a second rotatory body drive section 43 that rotationally drives the second rotatory body 4. The second rotatory body drive section 43 is for example an electric motor.

The outer circumferential surface 41 is disposed in contact with an outer circumferential surface 11 of the first rotatory body 1. The first rotatory body 1 is driven to rotate by the rotation of the second rotatory body 4. Thus, the first rotatory body 1 and the second rotatory body 4 form a fixing nip N therebetween where a recording medium P onto which toner TN has been transferred becomes sandwiched. The exterior of the first rotatory body 1 opposite to the fixing nip N and the exterior of the first and second rotatory bodies 1 and 4 at opposite axial ends thereof are enclosed by a housing.

The two first heaters 6 heat the fixing nip N. The first heaters 6 include a halogen heater or a ceramic heater, for example. One of the two first heaters 6 is located downstream of a supporting member 3 in terms of the conveyance direction D within the first rotatory body 1, and the other is located upstream of the supporting member 3. The first heaters 6 apply heat to the recording medium P being conveyed through the fixing nip N via the first rotatory body 1. The toner TN transferred onto the recording medium P is melted and fixed thereon while the recording medium P is passing through the fixing nip N.

The fixing device 100 further includes a pressure receiving member 2 and the supporting member 3. The pressure receiving member 2 has a C-shape that opens, in a cross-sectional view in the axial direction, to the center of the first rotatory body 1 in terms of the radial direction. More specifically, the pressure receiving member 2 has a sliding contact plate section 21, two side plate sections 22, and two canted plate sections 23. The sliding contact plate section 21 is disposed in parallel with the fixing nip N. The two side plate sections 22 extend perpendicularly relative to the sliding contact plate section 21. Each of the two canted plate sections 23 connects one of the side plate sections 22 to one of the opposite ends of the sliding contact plate section 21 which is parallel to the conveyance direction D of the recording medium P. The pressure receiving member 2 is formed from a steel use stainless (SUS) member having a thickness of 0.2 mm, for example. The pressure receiving member 2 extends along the axial direction within the first rotatory body 1. Opposite ends of the pressure receiving member 2 in terms of the axial direction are secured to the housing.

The pressure receiving member 2 and the second rotatory body 4 form the fixing nip N with the first rotatory body 1 therebetween. An inner circumferential surface 12 of the first rotatory body 1 slides on the sliding contact plate section 21 and the canted plate sections 23 at a lower section of the first rotatory body 1 as the first rotatory body 1 rotates. The pressure receiving member 2 needs to have a certain degree of strength for receiving pressure from the second rotatory body 4 onto the first rotatory body 1. The pressure receiving member 2 preferably has high heat capacity, high heat resistance, and high abrasion resistance since the pressure receiving member 2 is in contact with the inner circumferential surface 12 of the first rotatory body 1. The pressure receiving member 2 is formed from SUS, for example. Alternatively, the pressure receiving member 2 may be formed from a resin.

The supporting member 3 is substantially T-shaped (has a shape including a T-shape) in a cross-sectional view in the axial direction. More specifically, the supporting member 3 includes a lower-end plate section 31 and a standing plate section 32, a heat insulating member 33, and a reflection member 34. The supporting member 3 is formed from a SUS member having a thickness of 3 mm, for example. The lower-end plate section 31 is disposed on the sliding contact plate section 21 of the pressure receiving member 2 with the heat insulating member 33 therebetween. The standing plate section 32 extends through the center of the first rotatory body 1 in terms of the radial direction to a position close to the inner circumferential surface 12 of the first rotatory body 1 at a section of the first rotatory body 1 that is opposite to the fixing nip N. A surface of the lower-end plate section 31 and opposite surfaces of the standing plate section 32 are entirely covered by the reflection member 34. The reflection member 34 is formed from an aluminum or gold film having a thickness of 0.5 mm, for example. The reflection member 34 reflects radiation heat from the first heaters 6 in order to prevent light-heat conversion of the radiation heat. The heat insulating member 33 is for example formed from heat resistant silicone sponge, silicone fiber processed fabric, or glass wool having a thickness of 2 mm. The heat insulating member 33 prevents heat transfer from the pressure receiving member 2 to the supporting member 3.

Like the pressure receiving member 2, the supporting member 3 extends along the axial direction, and opposite ends thereof in terms of the axial direction are secured to the housing. The supporting member 3 is disposed within the first rotatory body 1. The supporting member 3 receives pressure from the second rotatory body 4 onto the pressure receiving member 2 and supports the pressure receiving member 2. As a result, the pressure (fixing pressure) at the fixing nip N is stabilized, and thus sufficient pressure is applied to the recording medium P passing through the fixing nip N.

The temperature detection section 5 is disposed opposite to the outer circumferential surface 11 of the first rotatory body 1 and close to an end portion of the outer circumferential surface 11 of the first rotatory body 1. The temperature detection section 5 detects temperature at one of opposite axial ends of the first rotatory body 1. Alternatively, the temperature may be detected at both the axial ends. The temperature detection section 5 is located upstream of the fixing nip N in terms of the rotation direction R1 of the first rotatory body 1. The temperature detection section 5 is a temperature sensor that detects temperature (e.g., a thermistor). The temperature detection section 5 detects a change in the temperature of the heat that is transferred thereto from a temperature detection position L at the axial end of the outer circumferential surface 11 of the first rotatory body 1 without touching the outer circumferential surface 11 of the first rotatory body 1. Hereinafter, the "temperature of the heat that is transferred from the outer circumferential surface 11 (surface) of the first rotatory body 1" will be referred to simply as "surface temperature".

The control section 8 is mounted on a control board. The control section 8 includes a determination section 81. The determination section 81 includes a rotation determination section 81*a* and a failure determination section 81*b*. The determination section 81 determines the state of rotation of the first rotatory body 1 based on a result of detection by the temperature detection section 5 after the first heaters 6 start heating. More specifically, the determination section 81 (the rotation determination section 81*a* and the failure determination section 81*b*) determines that the first rotatory body 1 is rotating when the amount of change in the surface temperature at the temperature detection position L is equal to or greater than a threshold value. It is determined that the state of rotation is abnormal when the amount of change in the surface temperature is smaller than the threshold value.

The control section 8 further includes a second rotatory body drive control section 82, a heater control section 83, and a notification section 84. The notification section 84 is connected with a display output section 85. The second rotatory body drive control section 82 controls the rotation of the second rotatory body 4 based on a result of determination by the determination section 81. More specifically, the second rotatory body drive control section 82 outputs a control signal S2 to the second rotatory body drive section 43 based on a determination signal S1 that is output from the determination section 81. The second rotatory body drive section 43 controls the rotational drive of the second rotatory body 4 to be stopped or continued based on the control signal S2 output from the second rotatory body drive control section 82.

The heater control section 83 controls heat generation of the first heaters 6 based on a result of determination by the determination section 81. The heater control section 83 outputs an ON/OFF signal S3 to a switch in a power supply circuit for supplying power from a power source to the first heaters 6 based on the determination signal S1 output from the determination section 81. The heater control section 83 outputs an ON signal S3 to control the first heaters 6 to perform heating on the first rotatory body 1 (heat generation by the first heaters 6). Likewise, the heater control section 83 outputs an OFF signal S3 to control the first heaters 6 to not start heating when the heating is prior to being performed and to stop heating while the heating is being performed.

The notification section 84 outputs a control signal S4 to the display output section 85 based on the determination signal S1 output from the determination section 81. Thus, the display output section 85 is controlled to display or not display a warning indicating a failure in the fixing device 100. The display output section 85 notifies of the warning by lighting or text, for example. The notification section 84 may employ, instead of the display output section 85, a warning sounding section that issues a warning using sound or may employ a combination of the warning display and the warning sound.

Figure 2:
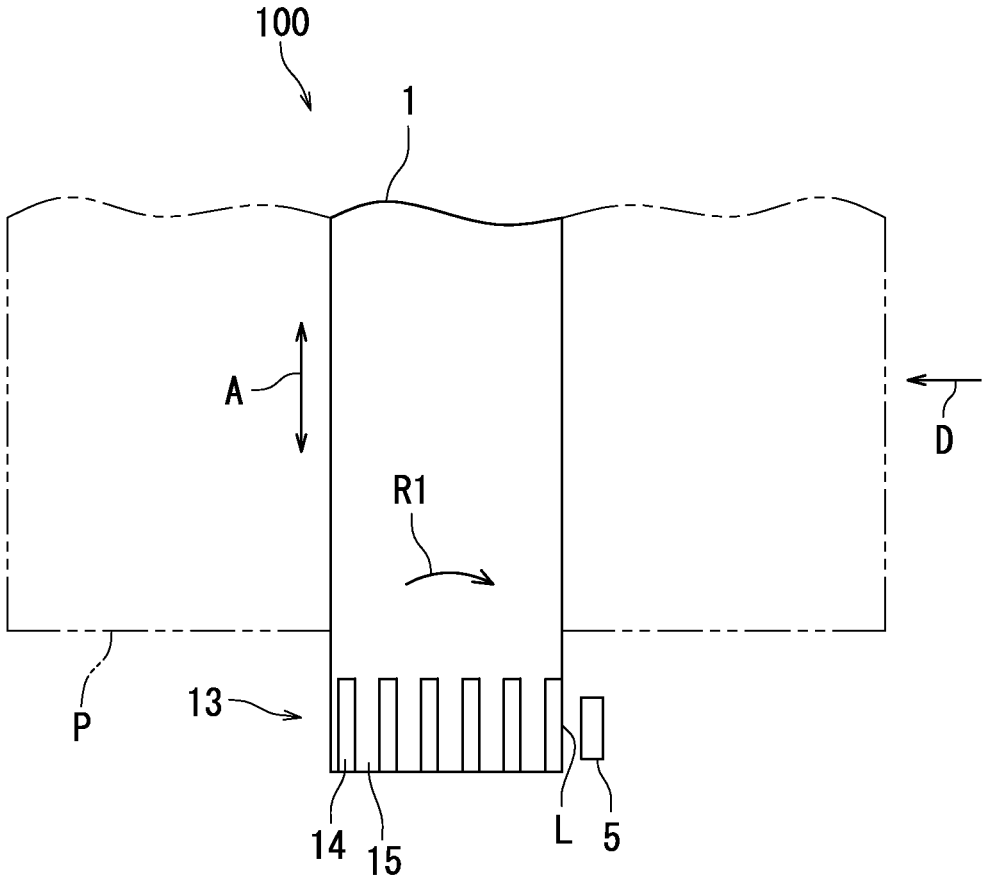
FIG. 2 is a schematic plan view illustrating a first rotatory body in the fixing device according to the first embodiment of the present disclosure.

End portions 13 of the first rotatory body 1 will be described with reference to FIG. 2. FIG. 2 is a schematic plan view illustrating the first rotatory body 1. In the present embodiment, the end portions 13 are at opposite ends of the first rotatory body 1 in terms of an axial direction A. The end portions 13 refer to portions that the recording medium P does not contact while passing through the fixing nip N (see FIG. 1).

The end portions 13 each have first regions 14 and second regions 15 that are adjacent to the first regions 14. The first regions 14 and the second regions 15 are three-dimensional regions each having a depth (thickness) in a radial direction of the first rotatory body 1. The first regions 14 and the second regions 15 are arranged in each end portion 13 alternately along the rotation direction R1 of the first rotatory body 1.

The first regions 14 have a first thermal conductivity. The first thermal conductivity is determined according to a combination of thermal conductivities of a plurality of layers included in the first regions 14. The second regions 15 have a second thermal conductivity that is different from the first thermal conductivity. The number of the first regions 14 is determined according to the maximum rotation speed (maximum rotation rate) of the first rotatory body 1. For example, in a configuration in which the rotatory body 1 has a large rotation speed under control conditions preset for the second rotatory body drive control section 82, the number of first regions 14 may be limited to a relatively small number as long as the number is large enough to allow temperature change detection.

While the first rotatory body 1 is rotating, surfaces of the first regions 14 and surfaces of the second regions 15 alternately pass the temperature detection position L. The temperature detection section 5 continuously detects the surface temperature at the temperature detection position L to detect a surface temperature change (surface temperature difference) between the first regions 14 and the second regions 15 according to a thermal conductivity difference therebetween. The temperature detection section 5 is therefore less susceptible to irregularities, the color, or the gloss in the outer circumferential surface 11 of the first rotatory body 1 in the temperature detection. Preferably, the first regions 14 and the second regions 15 are arranged at regular intervals in order that the temperature change can be measured in a periodical and stable manner. Alternatively, the first regions 14 and the second regions 15 may not be arranged at regular intervals as long as the temperature change can be measured.

Figure 3:
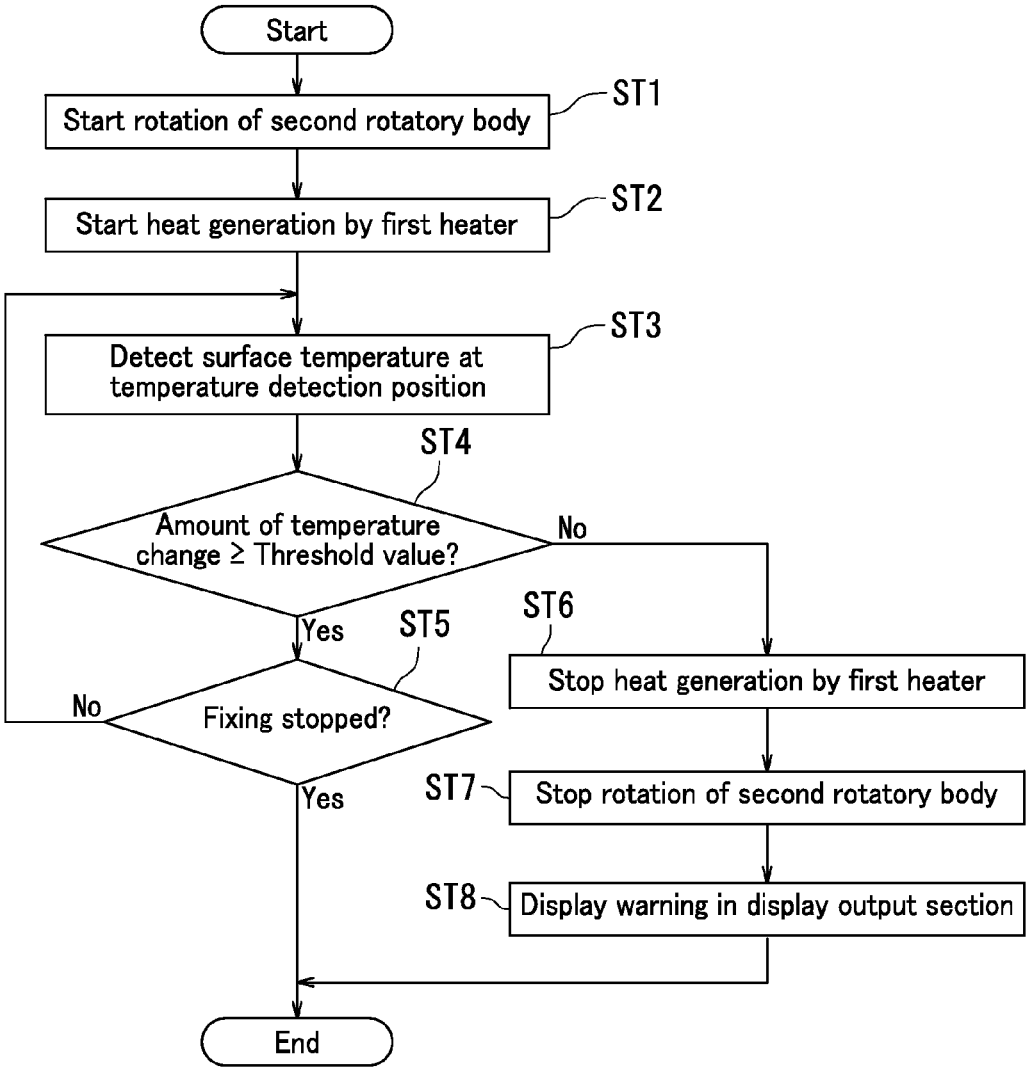
FIG. 3 is a flowchart illustrating a determination process that is performed in the fixing device according to the first embodiment of the present disclosure.

A specific example of the determination process by the rotation determination section 81*a* and the failure determination section 81*b* will be described with reference to FIGS. 1 and 3. FIG. 3 shows a flowchart illustrating the determination process that is performed in the fixing device 100.

In Step ST1, rotation of the second rotatory body 4 is started. More specifically, the second rotatory body drive control section 82 controls the second rotatory body drive section 43 to rotationally drive the second rotatory body 4. The first rotatory body 1 is driven to rotate by the rotation of the second rotatory body 4.

In Step ST2, heat generation of the first heaters 6 is started. More specifically, once the first rotatory body 1 is driven to start rotating, the heater control section 83 outputs an ON signal S3 to the switch in the power supply circuit for supplying power from a power source to the first heaters 6. The heater control section 83 thereby controls the first heaters 6 to start heating the first rotatory body 1 (heat generation). Thus, the fixing device 100 melts the toner TN adhering to the recording medium P passing through the fixing nip N. At the same time, the fixing device 100 fixes the toner TN on the recording medium P by applying pressure onto the recording medium P using the second rotatory body 4.

In Step ST3, the temperature detection section 5 detects the surface temperature at the temperature detection position L while the first heaters 6 are performing the heating. The temperature detection section 5 continuously detects the temperature so that a temperature change with the rotation of the first rotatory body 1 is periodically detected. A period of time during which the surface temperature of one first region 14 is detected at the detection position L and the surface temperature of one second region 15 is detected at the detection position L is one period. In a situation in which the first regions 14 have a higher thermal conductivity than the second regions 15, the surface temperature detected during one period is at a maximum value at a moment when the first region 14 passes the temperature detection position L and is at a minimum value at a moment when the second region 15 passes the temperature detection position L.

In Step ST4, it is determined whether or not the amount of temperature change is equal to or greater than a threshold value. More specifically, the determination section 81 (the rotation determination section 81*a* and the failure determination section 81*b*) determines whether or not the first rotatory body 1 is rotating based on a difference between the maximum surface temperature value and the minimum surface temperature value (the amount of temperature change) that have been detected during one period. The threshold value of the temperature change is preliminarily determined according to: the space intervals between the first regions 14 and the second regions 15; the rotation speed of the first rotatory body 1; and the thermal conductivity of the first regions 14 and the thermal conductivity of the second regions 15. When the amount of temperature change is equal to or greater than the threshold value (Yes), the rotation determination section 81*a* determines that the first rotatory body 1 is rotating and outputs a determination signal S1. Then, the determination process proceeds to Step ST5. When the amount of temperature change is smaller than the threshold value (No), the failure determination section 81*b* determines that the rotation is abnormal and outputs a determination signal S1. Then, the determination process proceeds to Step ST6.

A typical situation in which the determination section 81 determines that the first rotatory body 1 is not rotating (the rotation of the first rotatory body 1 is abnormal) is when the first rotatory body 1 is not driven to rotate due to slippage between the outer circumferential surface 11 of the first rotatory body 1 and the outer circumferential surface 41 of the second rotatory body 4. In another typical situation, the second rotatory body 4 is not rotating at all due to a malfunction of the second rotatory body drive section 43.

When the fixing by the fixing device 100 is suspended (Yes) in Step ST5, the determination process comes to an end. When the fixing is not suspended (No), the determination process returns to the beginning of Step ST3, and the temperature detection section 5 continues to detect the surface temperature at the temperature detection position L. Thus, the determination process is repeated until the fixing by the fixing device 100 is stopped.

In Step ST6, the heater control section 83 outputs a control signal S3 based on the determination signal S1 output from the rotation determination section 81*a* or the failure determination section 81*b*. Thus, the power supply circuit is switched off. Then, the power supply from the power source to the first heaters 6 is stopped. The heating by the first heaters 6 is stopped as described above.

In Step ST7, the second rotatory body drive control section 82 outputs a control signal S2 to the second rotatory body drive section 43 to control the same to stop rotationally driving the second rotatory body 4 based on the determination signal S1 output from the rotation determination section 81*a* or the failure determination section 81*b*.

In Step ST8, the notification section 84 outputs a control signal S4 to the display output section 85 based on the determination signal S1 output from the rotation determination section 81*a* or the failure determination section 81*b*, and thus controls the display output section 85 to display a warning. After Step ST8, the determination process comes to an end.

As described with reference to FIGS. 1-3, each end portion 13 of the first rotatory body 1 in the fixing device 100 according to the first embodiment has the first regions 14 having the first thermal conductivity and the second regions 15 having the second thermal conductivity. The temperature detection section 5 detects a change in the surface temperature at the temperature detection position L according to the thermal conductivity difference between the first regions 14 and the second regions 15. The determination section 81 determines the presence or absence of rotation of the first rotatory body 1 based on a result of detection by the temperature detection section 5. It is therefore possible to prevent an erroneous determination with respect to the state of rotation of the first rotatory body 1. As a result, it is possible to swiftly stop the heating by the first heaters 6 in case of abnormal rotation of the first rotatory body 1.

Figure 4A:
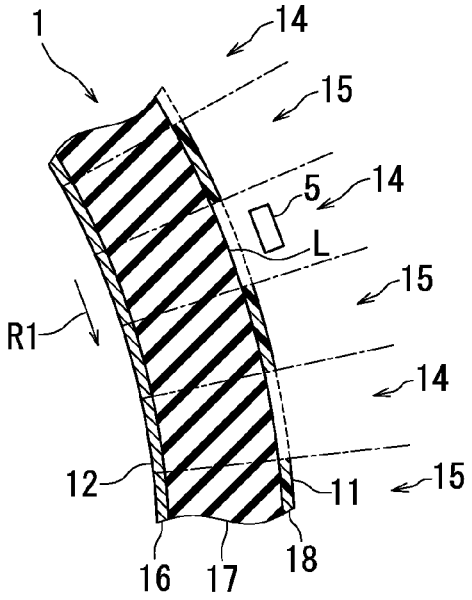
FIGS. 4A-4D are enlarged side views schematically illustrating a part of the first rotatory body in the fixing device according to the first embodiment of the present disclosure.
Figure 4B:
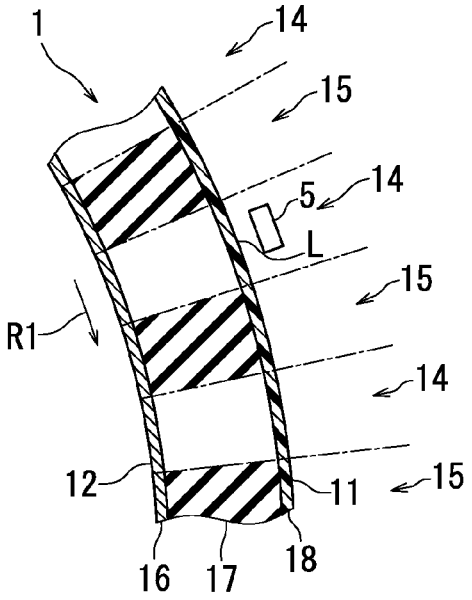

Preferably, the number of layers in each of the first regions 14 and the number of layers in each of the second regions are different so that the thermal conductivity of the first regions 14 and the thermal conductivity of the second regions 15 are different. FIGS. 4A-4D are enlarged side views schematically illustrating a part of the first rotatory body 1. More specifically, as illustrated in FIGS. 4A and 4B, the first regions 14 each include two layers stacked on top of one another, and the second regions 15 each include three layers stacked on top of one another. Specifically, FIG. 4A illustrates a configuration in which only a release layer 18 has been removed from the three layers (a metal layer 16, an elastic layer 17, and the release layer 18) in the first regions 14. The metal layer 16 has a higher thermal conductivity than the release layer 18. The release layer 18 has a higher thermal conductivity than the elastic layer 17. The elastic layer 17 is exposed where the release layer 18 is removed. Air is present between the elastic layer 17 that is exposed and the temperature detection section 5. The heat is therefore transferred through the air in sections without the release layer 18. The air has a lower thermal conductivity than the elastic layer 17. Since the air at the uppermost surface of each first region 14 has a lower thermal conductivity than the release layer 18 constituting the uppermost surface of each second region 15, the first thermal conductivity of the first regions 14 is lower than the second thermal conductivity of the second regions 15. Thus, the thermal conductivity can be readily changed. FIG. 4B illustrates a configuration in which only the elastic layer 17 has been removed from the three layers in the first regions 14. Since the heat is transferred through air in sections without the elastic layer 17, the first thermal conductivity of the first regions 14 will be lower than the second thermal conductivity of the second regions 15. Thus, the thermal conductivity can be readily changed.

Figure 4C:
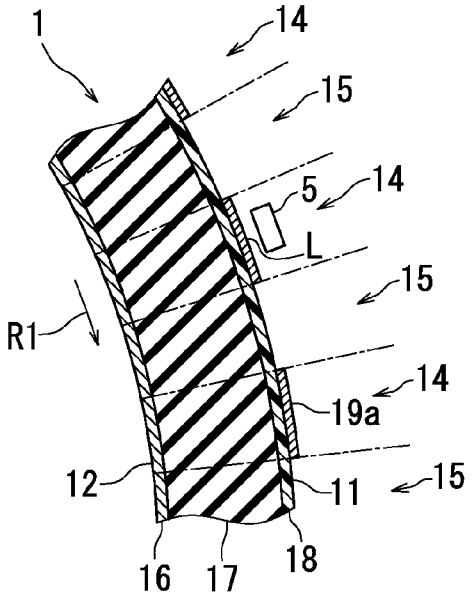
Figure 4D:
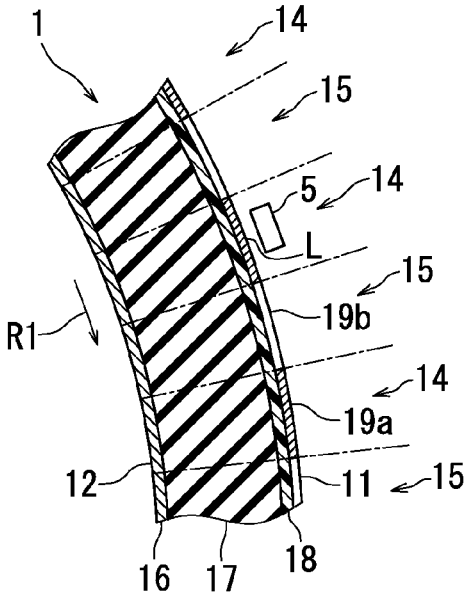

Alternatively, the layers of the first rotatory body 1 may be formed as illustrated in FIGS. 4C and 4D so that the thermal conductivity of the uppermost layer of each first region 14 is higher than the thermal conductivity of the uppermost layer of each second region 15. FIG. 4C illustrates a configuration in which the first regions 14 have a heat-conducting member 19*a* as an uppermost layer. The heat-conducting member 19*a* is for example a sheeted metal piece. The heat-conducting member 19*a* is secured to the surface of each first region 14. The heat-conducting member 19*a* has a higher thermal conductivity than the release layer 18. FIG. 4D illustrates a configuration in which the first regions 14 have a heat-conducting member 19*a* and the second regions 15 have a member 19*b*. The member 19*b* is a material having a lower thermal conductivity than the heat-conducting member 19*a*. Accordingly, the first thermal conductivity is higher than the second thermal conductivity, making the thermal conductivity difference between the first regions 14 and the second regions 15 more distinctive.

Second Embodiment

Figure 5:
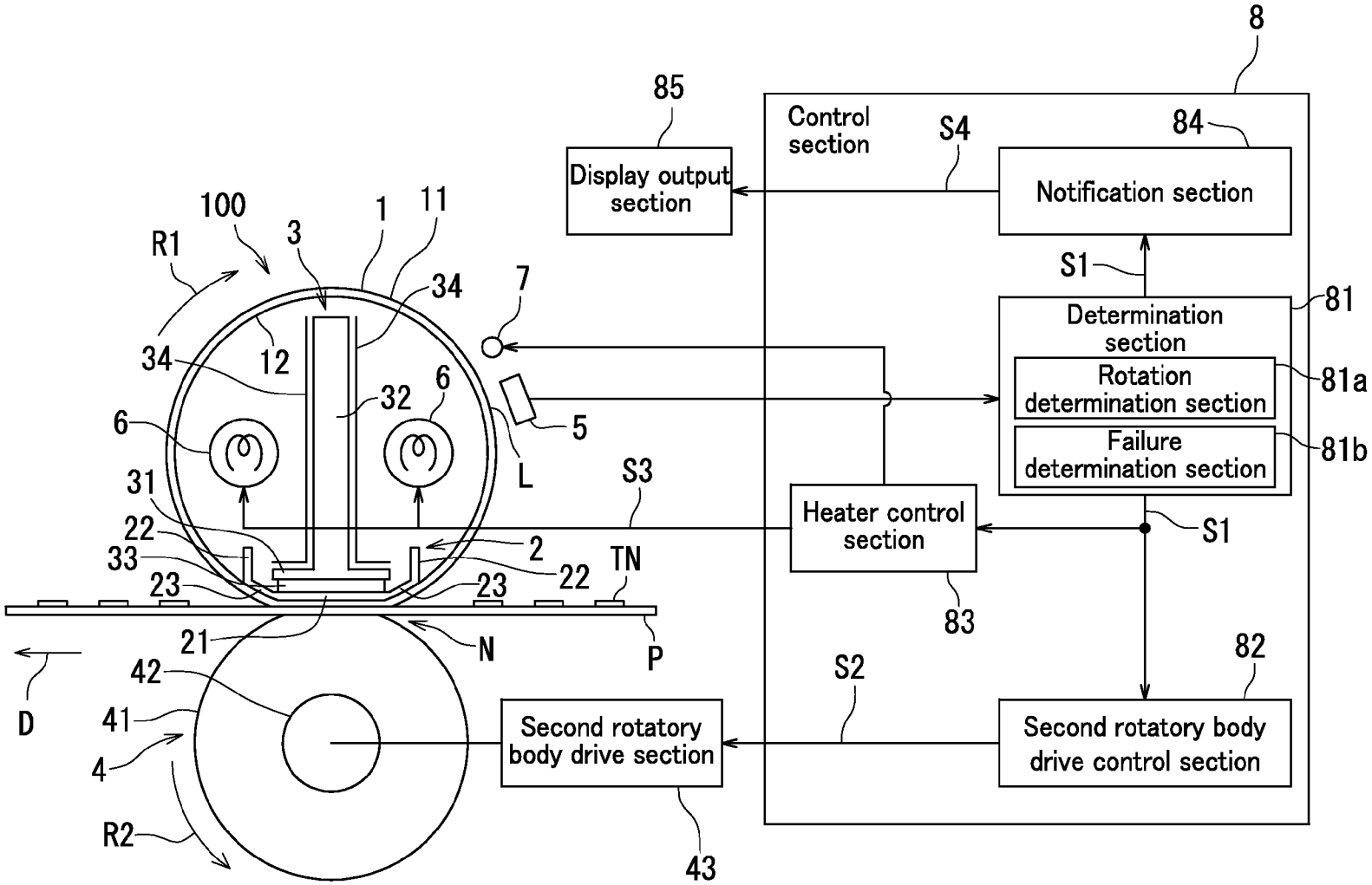
FIG. 5 is a block diagram illustrating functions of a fixing device according to a second embodiment of the present disclosure.

A fixing device 100 according to a second embodiment of the present disclosure will be described with reference to FIG. 5. FIG. 5 is a block diagram illustrating functions of the fixing device 100. The second embodiment is different from the first embodiment in that the fixing device 100 of the second embodiment further includes a second heater 7 for heating an end portion 13 (first regions 14 and second regions 15).

The fixing device 100 includes the second heater 7 that is disposed independently from the first heaters 6. For example, the second heater 7 is disposed opposite to the end portion 13 of the outer circumferential surface 11 of the first rotatory body 1. Preferably, the second heater 7 is located upstream of the temperature detection section 5 in terms of the rotation direction R1. This arrangement allows the temperature detection section 5 to swiftly detect the surface temperature with respect to the first regions 14 and the second regions 15 that have been heated by the second heater 7.

The detailed description of the end portion 13 of the first rotatory body 1 made with reference to FIGS. 2 and 4A-4D applies to the second embodiment, and therefore illustration thereof is omitted. The second heater 7 heats the end portion 13 from the outside of the first rotatory body 1. The surface temperature at the temperature detection position L changes depending mainly on the thermal conductivity of the outermost layers (e.g., the release layer 18) of the first regions 14 and the second regions 15.

The determination process that is performed in the fixing device 100 of the second embodiment includes the same steps as Step ST1 to Step ST8 in the first embodiment described with reference to FIG. 3. Therefore, the flowchart showing the steps is omitted. In Steps ST2 and ST6, the heater control section 83 controls the start and the end of heat generation by the second heater 7 in association with the control of the first heaters 6. Alternatively, the heater control section 83 may control the first heaters 6 and the second heater 7 separately.

Preferably, a preheating heater that is used while the fixing device 100 is idle serves as the second heater 7. This configuration allows the temperature detection section 5 to be able to detect a temperature change in the end portion 13 in a stable manner even if the fixing device 100 is controlled so that the first heaters 6 are turned off while the first rotatory body 1 is rotating.

Figure 6A:
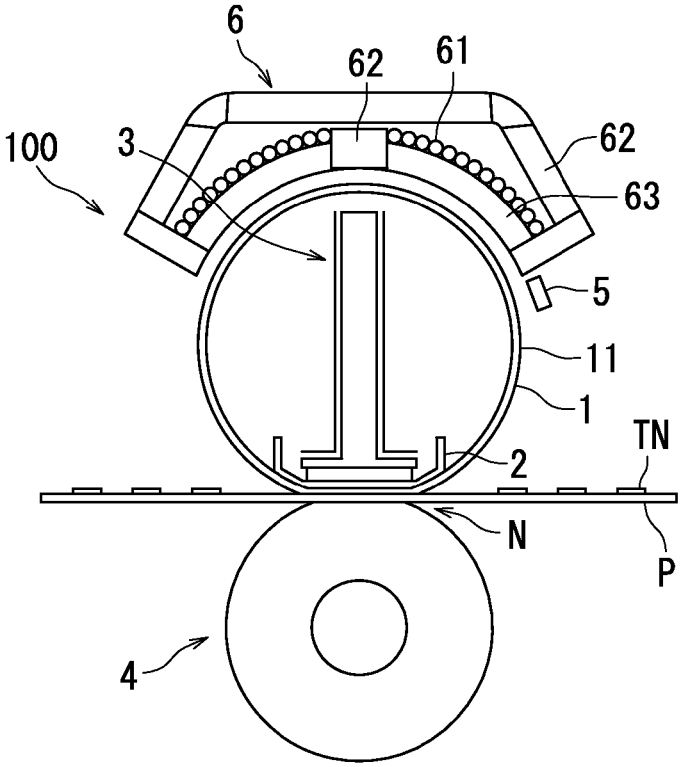
FIGS. 6A and 6B are schematic side views illustrating variations of the fixing device according to the first embodiment of the present disclosure.
Figure 6B:
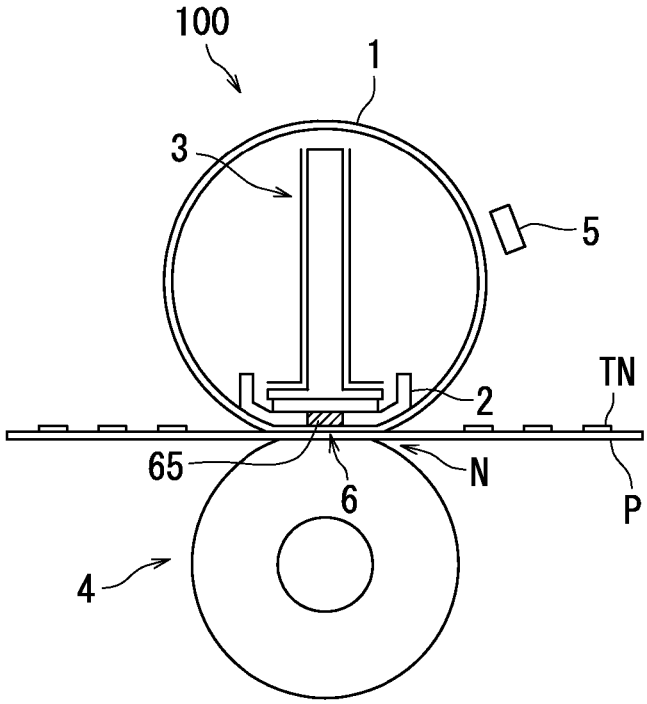

The first heater 6 as illustrated in FIGS. 6A and 6B may include an electromagnetic induction coil 61 or a resistance heating element 65. FIGS. 6A and 6B are schematic side views illustrating variations of the fixing device 100. The second heater 7 is not shown in order to avoid overcomplicating the drawing.

The first heater 6 in FIG. 6A includes the electromagnetic induction coil 61, a magnetic core 62, and a bobbin 63 that are located outside of the first rotatory body 1. The first rotatory body 1 further includes an electromagnetic induction heat generation layer. The first heater 6 extends in a circumferential direction of the first rotatory body 1 and is disposed opposite to the first rotatory body 1 so as to surround a substantially half of the outer circumferential surface 11. A magnetic flux generated through the electromagnetic induction coil 61 causes the electromagnetic induction heat generation layer to generate heat, and thus causes heating of the first rotatory body 1.

The first heater 6 in FIG. 6B includes the resistance heating element 65 disposed in the vicinity of the fixing nip N. The first heater 6 is for example a ceramic heater. The resistance heating element 65 is held by the pressure receiving member 2.

Third Embodiment

Figure 7:
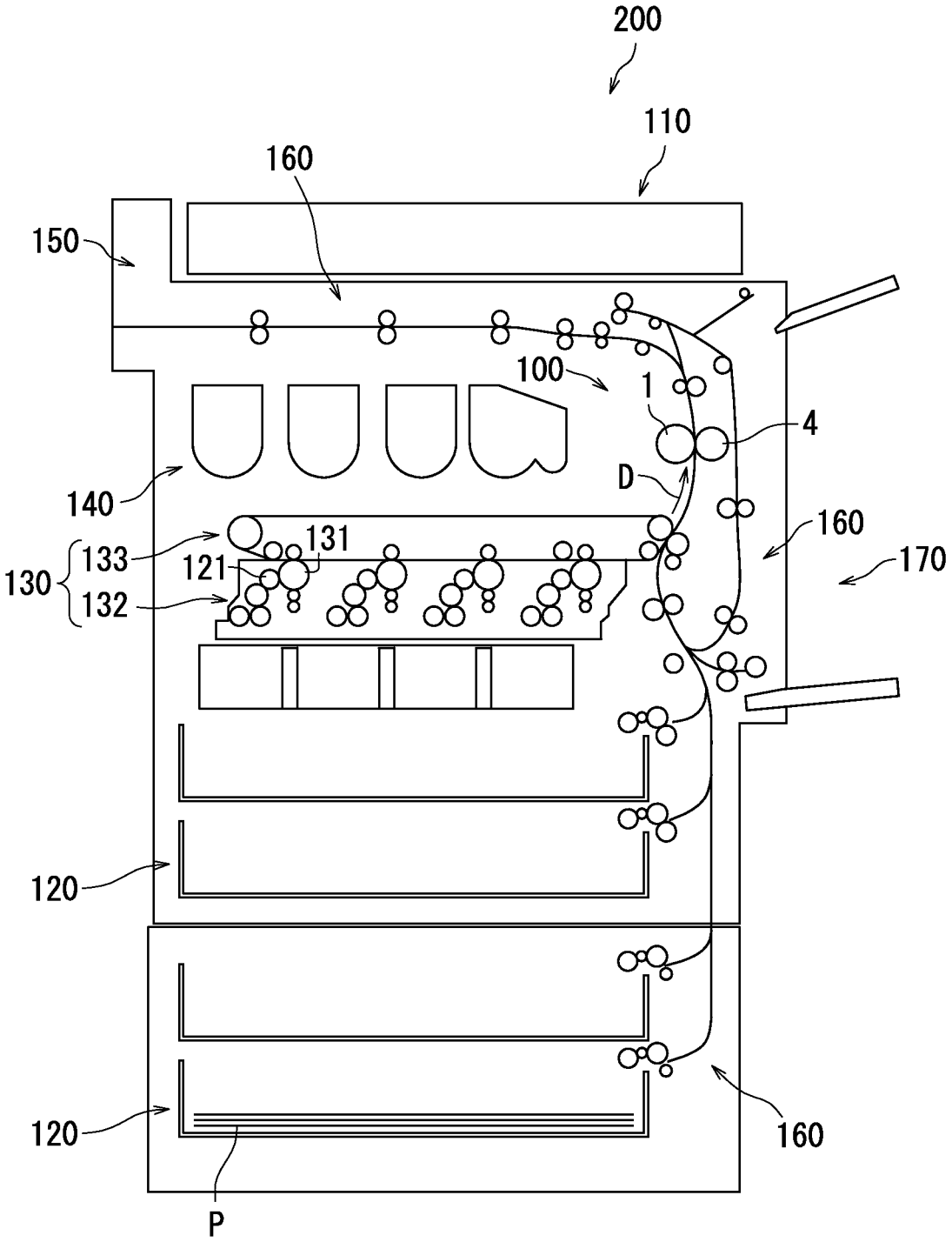
FIG. 7 is a schematic side view illustrating an image forming apparatus according to a third embodiment of the present disclosure.

FIG. 7 is a schematic diagram illustrating an image forming apparatus 200 according to a third embodiment of the present disclosure. The image forming apparatus 200 can be a copier, a printer, a facsimile machine, or a multifunction peripheral that implements functions of the aforementioned machines. Hereinafter, the present disclosure will be described using a copier as an example of the image forming apparatus 200, but the present disclosure is not limited thereto. The image forming apparatus 200 includes the fixing device 100, an image reading section 110, and an image forming section 170. The image forming section 170 has sheet feed cassettes 120, an imaging section 130, a toner replenishment device 140, a sheet ejecting section 150, and a sheet conveyance section 160. The image forming section 170 forms an image based on image data that is read by the image reading section 110.

The sheet feed cassettes 120 each store therein a recording medium P for printing. In a copying operation, the recording medium P in a sheet feed cassette 120 is conveyed by the sheet conveyance section 160 to be ejected from a sheet ejecting section 150 after passing through the imaging section 130 and the fixing device 100.

The imaging section 130 forms a toner image on the recording medium P. The imaging section 130 includes photosensitive members 131, developing devices 132, and a transfer device 133.

An electrostatic latent image is formed on each photosensitive member 131 with laser light based on an electronic signal representing an original image generated in the image reading section 110. Each developing device 132 has a developing roller 121. Each developing roller 121 is used to supply toner to the corresponding photosensitive member 131 to develop the electrostatic latent image. Thus, a toner image is formed on each photosensitive member 131. The toner replenishment device 140 replenishes the respective developing devices 132 with toner.

The transfer device 133 transfers the toner images formed on the respective photosensitive members 131 to the recording medium P.

The fixing device 100 applies heat and pressure onto the recording medium P to melt and fix, on the recording medium P, the unfixed toner images formed in the imaging section 130.

So far, the embodiments of the present disclosure have been described with reference to the drawings (FIGS. 1-7). However, the present disclosure is not limited to the above-described embodiments and can be practiced in various ways within the scope not departing from the essence of the present disclosure (e.g., as described below in sections (1)-(8)). The drawings are intended to emphasize the components in a schematic manner to assist with understanding. The thickness, the length, and the number of the components illustrated, and also spaces therebetween, are not true to scale for diagrammatic purposes. The material, the shape, the dimensions, and so on of each component shown in the above-described embodiments are only exemplary and do not represent any particular limitations. Various alternations can be made thereto within the scope not substantially departing from the effect of the present disclosure.

(1) In the configuration of the fixing device 100 described with reference to FIGS. 1, 6A, and 6B, the temperature detection section 5 is located upstream of the fixing nip N in terms of the rotation direction R1 of the first rotatory body 1. Alternatively, the temperature detection section 5 may be located downstream of the fixing nip N. Furthermore, the fixing device 100 may have a plurality of temperature detection sections 5.

(2) The first regions 14 and the second regions 15 of the first rotatory body 1 may have a configuration and a thermal conductivity opposite to those described with reference to FIGS. 4A-4D. For example, although the release layer 18 is removed in the first regions 14 in FIG. 4A, the release layer 18 may be removed in the second regions 15 rather than in the first regions 14.

(3) The configuration of the first rotatory body 1 described with reference to FIGS. 4A and 4B may be combined with the configuration of the first rotatory body 1 described with reference to FIGS. 4C and 4D. For example, the heat-conducting member 19*a* illustrated in FIG. 4C may be formed as an uppermost layer over the release layer 18 of the outer circumferential surface 11 in each second region 15 illustrated in FIG. 4A. This configuration makes the thermal conductivity difference between the first regions 14 and the second regions 15 more distinctive.

(4) The number and the arrangement of the first heaters 6 are not particularly limited to the configurations of the fixing device 100 described with reference to FIGS. 1-7. Furthermore, although configurations have been described in which the first heaters 6 include a halogen heater, the electromagnetic induction coil 61, or the resistance heating element 65, for example, the present disclosure is not limited to such configurations.

(5) In the configurations of the fixing device 100 described with reference to FIGS. 1-7, the first heaters 6 directly heat the first rotatory body 1. Alternatively, for example, the first heaters 6 may heat the first rotatory body 1 via the second rotatory body 4, or another heating roller may be provided and the first heaters 6 may heat the first rotatory body 1 via the heating roller.

(6) In the configuration of the fixing device 100 described with reference to FIG. 5, the second heater 7 is disposed outside of the first rotatory body 1. Alternatively, the second heater 7 may be disposed inside of the first rotatory body 1. The temperature detection section 5 detects the temperature of the heat transferred thereto from the second heater 7 through the three layers of the first rotatory body 1.

(7) In the configurations of the fixing device 100 described with reference to FIGS. 1-7, the second rotatory body 4 (pressure roller) is rotationally driven and the first rotatory body 1 (heating rotatory body) is driven to rotate by the rotation of the second rotatory body 4. However, the present disclosure is not limited to the described configurations. For example, the first rotatory body 1 may be rotationally driven and the second rotatory body 4 may be driven to rotate by the rotation of the first rotatory body 1. In this case, the first rotatory body 1 may have a solid cylindrical form instead of an endless belt form. In addition, a pressure rotatory body formed from an endless flexible belt may be used as a pressure roller instead of the second rotatory body 4.

(8) In the configurations of the fixing device 100 described with reference to FIGS. 1-7, the rotational drive control of the second rotatory body 4 and the heat generation control of the first heaters 6 are performed automatically based on the determination signal S1 output from the rotation determination section 81*a*. However, the present disclosure is not limited to the described configurations. For example, a person who has seen a warning displayed by the display output section 85 may manually perform the rotational drive control of the second rotatory body 4 and the heat generation control of the first heaters 6.

What is claimed is:

1. A fixing device for fixing a toner on a recording medium, comprising:

a first rotatory body that is rotatable in a circumferential direction thereof;

a first heater configured to heat the first rotatory body;

a second rotatory body disposed opposite to the first rotatory body, the second rotatory body being rotatable, the first rotatory body and the second rotatory body providing a fixing nip therebetween where the recording medium becomes sandwiched;

a temperature detection section configured to detect a temperature change in an end portion of an outer circumferential surface of the first rotatory body; and a determination section configured to determine a state of rotation of the first rotatory body based on a result of detection by the temperature detection section, wherein the end portion of the first rotatory body has at least one first region and at least one second region, the first region and the second region being arranged adjacent to each other along the circumferential direction, the first region has a first thermal conductivity, and the second region has a second thermal conductivity that is different from the first thermal conductivity.

2. The fixing device according to claim 1, further comprising a second heater configured to heat the first region and the second region.

3. The fixing device according to claim 1, wherein the first rotatory body includes a plurality of layers, and a different number of the layers are present in the first region compared to the second region.

4. The fixing device according to claim 3, wherein a material that forms an uppermost layer of the layers in the first region has a higher thermal conductivity than a material that forms an uppermost layer of the layers in the second region.

5. The fixing device according to claim 1, wherein a number of the first regions is in accordance with a maximum rotation speed of the first rotatory body.

6. The fixing device according to claim 1, wherein the first heater includes any one of a halogen heater, an electromagnetic induction coil, and a resistance heating element.

7. The fixing device according to claim 1, further comprising:

a heater control section configured to control heat generation by the first heater based on a result of determination by the determination section; and a second rotatory body drive control section configured to control rotation of the second rotatory body based on a result of determination by the determination section.

8. An image forming apparatus comprising:

the fixing device according to claim 1; and an image forming section configured to transfer the toner to the recording medium, wherein the fixing device fixes the toner on the recording medium.

* * * * *